US009816356B2

(12) United States Patent
Ageev et al.

(10) Patent No.: US 9,816,356 B2
(45) Date of Patent: Nov. 14, 2017

(54) METHOD FOR EXTRACTING METHANE FROM COAL BEDS AND FROM PENETRATING ROCK ENCLOSING A COAL BED

(71) Applicant: GEOREZONANS LTD., Moscow (RU)

(72) Inventors: Petr Georgiyevich Ageev, Moscow (RU); Nikita Petrovich Ageev, Moscow (RU)

(73) Assignee: GEOREZONANS LTD., Moscow (RU)

( * ) Notice: Subject to any disclaimer, the term of this patent is extended or adjusted under 35 U.S.C. 154(b) by 0 days.

(21) Appl. No.: 15/150,996

(22) Filed: May 10, 2016

(65) Prior Publication Data

US 2016/0319644 A1 Nov. 3, 2016

Related U.S. Application Data

(63) Continuation of application No. PCT/RU2015/000188, filed on Mar. 27, 2015.

(51) Int. Cl.
*E21B 43/24* (2006.01)
*E21B 43/00* (2006.01)

(52) U.S. Cl.
CPC ..... *E21B 43/006* (2013.01); *E21B 43/2405* (2013.01)

(58) Field of Classification Search
CPC .... E21B 43/24; E21B 43/243; E21B 43/2401; E21B 43/247; E21B 43/30; E21B 36/04; E21B 17/028; E21B 47/065; E21B 43/168; E21B 43/166
See application file for complete search history.

(56) References Cited

U.S. PATENT DOCUMENTS

| | | | |
|---|---|---|---|
| 4,756,367 | A | 7/1988 | Puri et al. |
| 9,181,788 | B2 | 11/2015 | Ageev et al. |

FOREIGN PATENT DOCUMENTS

| | | | |
|---|---|---|---|
| RU | 2181446 | C1 | 4/2002 |
| RU | 2188322 | C1 | 8/2002 |
| RU | 2244106 | C1 | 1/2005 |
| RU | 2521098 | C2 * | 6/2014 |

OTHER PUBLICATIONS

International Search Report dated Aug. 18, 2015.

* cited by examiner

*Primary Examiner* — Zakiya W Bates
(74) *Attorney, Agent, or Firm* — Arent Fox LLP; Michael Fainberg

(57) ABSTRACT

Methods of extracting methane from coal beds using a plasma energy source configured to generate acoustic, electrical, mechanical and hydrodynamic compressive and rarefactive stresses by the action of periodic short pulses, produced by an explosion of a calibrated conductor of a source of oscillations placed in the working interval of a well.

18 Claims, 4 Drawing Sheets

METHOD FOR EXTRACTING METHANE FROM COAL BEDS AND FROM PENETRATING ROCK ENCLOSING A COAL BED

CROSS-REFERENCE TO RELATED APPLICATIONS

This application is a continuation of International Patent Application No. PCT/RU2015/000188, filed on Mar. 27, 2015, which claims priority to Russian Patent Application No. 2014108013, filed on Mar. 4, 2014, the contents of each of which are incorporated herein by reference in its entirety.

TECHNICAL FIELD

The invention relates to methods of extracting methane from coal beds and permeable enclosing rock by the periodic action of plasma energy produced by the explosion of a calibrated metallic conductor.

BACKGROUND

All of the known methods of extracting methane involve the extraction of gas solely from coal beds and do not consider extracting methane from the permeable enclosing rocks, which does not fully ensure the future working safety of the mine operators. Among the known methods used are:

- washing out of the bed/well around the borehole with the aid of spontaneous emissions of coal and gas;
- provocation and maintaining of self-destruction with formation of a collector zone by means of hydrodynamic action;
- injecting water and air, as well as carbon dioxide gas, into the coal bed;
- extraction of methane gas from single-shaft and multiple-shaft horizontal wells;
- formation of cavities around a well;
- extracting of methane gas through degasification wells;
- hydraulic fracturing of coal beds.

However, these methods are costly, labor-intensive, ecologically unsafe, energy-intensive and inefficient, as shown by the large number of both vertical and horizontal wells with no inflow of coalbed methane.

SUMMARY

The invention pertains to methods of extracting methane from coal beds and permeable enclosing rock by the periodic action of plasma energy applied to the producing coal bed and to the permeable enclosing rocks through a slit perforation, oriented in regard to the direction of the vectors of the principal stresses, produced by the explosion of a calibrated metallic conductor, resulting in the creation of directional short broadband pulses of high pressure of a pulsed plasma generator situated in the working interval of the vertical well shaft which is opened by the slit perforation for initiation of compressive and rarefactive stresses in the coal bed, and the occurrence of acoustic and hydrodynamic cavitation encouraging the formation of an extensive network of anomalous microfractures, which creates conditions for maximum desorption of methane from the coal, cracks, microcracks, micropores, capillaries and microcapillaries, and also from the permeable enclosing rocks (FIG. 1).

BRIEF DESCRIPTION OF THE DRAWINGS

The accompanying drawings, which are incorporated into and constitute a part of this specification, illustrate one or more example aspects of the present disclosure and, together with the detailed description, serve to explain their principles and implementations.

DETAILED DESCRIPTION OF EXEMPLARY EMBODIMENTS

Figure 1:
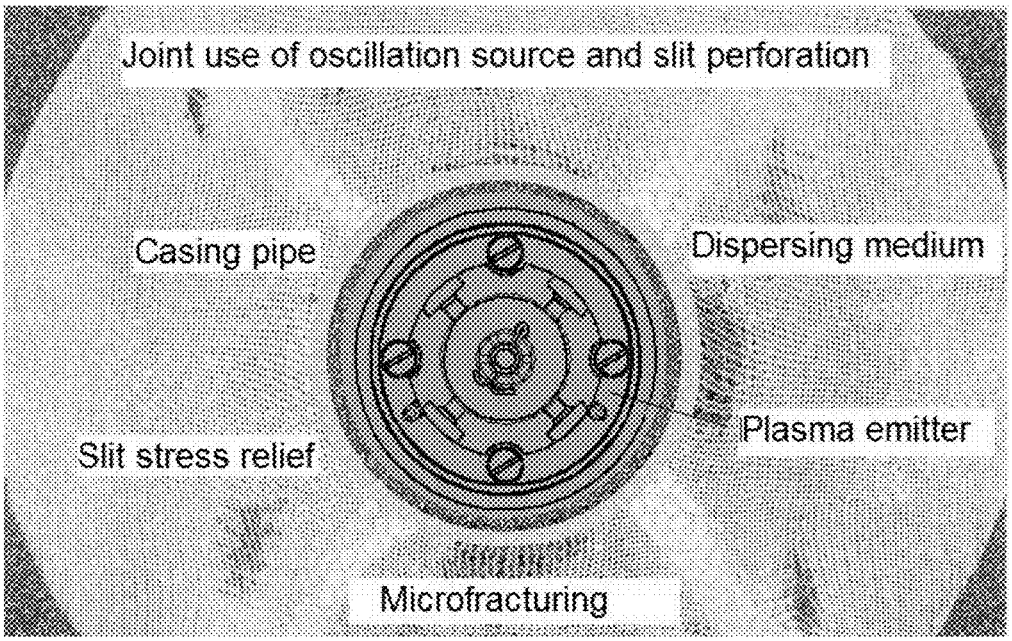
FIG. 1 is a diagram showing the result of the periodic action of plasma energy on a coal deposit according to aspects of the present invention.

Methods of extraction according to a general aspect of the present invention proceed as follows. The combination of slit perforation of the working interval of a well along the producing coal bed of any given metamorphism and at the same time along the more permeable enclosing rock allows the shock wave produced after the formation of plasma to penetrate radially without obstruction into the bed, as well as the enclosing rock, and also under periodic repetition of the pulses to repeatedly create compressive and rarefactive stresses, which enables maximum extraction of methane thanks to a synergistic effect (microfracturing, cavitation, heat and mass exchange, elimination of surface tension in capillaries, appearance of a concentration-diffusion force and accumulated outside energy), without resorting to other supplemental geological and technical measures.

In selected aspects, direct access to the coal bed and the permeable enclosing rocks is achieved through the slit perforation, and it allows for the physical, mechanical and geological technical peculiarities of the coal beds, as well as the permeable enclosing rocks, and as a result of the directional periodic broadband pulsed action according to a developed program and a mathematical model it creates an effect of self-modulation of the coal beds, accompanied by active desorption and diffusion of methane.

The following specific natural features are exploited by the program of broadband periodic pulsed plasma action applied to the coal bed through a slit perforation, in order to maximize the extraction of methane:

- the coal deposit not relieved of the load of the rock pressure and compressed by the enclosing rocks constitutes a porous system, often less dense than the rock strata;

the fluid (water) penetrating the coal deposit and its distribution along the vertical is controlled by capillary and gravitational forces;

coal beds with less permeability are distinguished by greater capillary pressure, and vice versa, coal beds and rocks with greater permeability have lower capillary pressure;

the capillary pressure increases with decreasing water saturation of the coal bed and promotes the process of desorption and diffusion of the gas;

the mechanical strength of coal is much lower than that of other rocks, and it is not able to withstand a high action gradient without being crushed. The paradox known as the P. W. Bridgeman effect has been established, namely, the breaking of bonds in the coal occurs upon releasing of the stress, and not upon its application. In these circumstances, the coal is broken up into wafer-like sheets;

the coal bed, being in a stressed state and having an elevated sound conductivity, has the properties of a nonequilibrium dissipative transmission medium, in which a natural frequency chaos is sustained by replenishment of outside energy (the tides, distant earthquakes, explosion work at remote sites being developed);

with regard to electrical properties, the majority of coals are semiconductors and conductors. Upon pulsed plasma action on the coal bed or enclosing permeable rock, mechanical and concentration-diffusion forces are produced, related to the displacement of the charged liquid in the porous fluid-saturated medium. Outside forces of electrokinetic origin appear, which create an electric field during each pulse. This passes into the energy of another field, and when the pulsed action ceases the accumulated outside energy returns, with certain losses, to its original form.

The gas saturated state of methane coal beds is made up of four components:

free gas filling the pores and cracks 5-6%;

gas adsorbed onto the walls of micropores, capillaries and cracks (physical sorption and volume filling) 28-35%;

gas located in the coal volume in dissolved form 40-50%;

gas partly dissolved in films of water, while according to Henry's law the gas solubility in aqueous solutions increases in direct proportion to the pressure with depth, 3-8%.

In gas-bearing beds, the main mass of the methane molecules is distributed in the coal volume and the concept of an interstitial solid solution is applicable to the system of methane and coal. The methane molecules interpenetrating the volume do not occupy voids in the crystal lattice, but rather vacancies in the solid in accordance with the sorption curve for coal beds.

There is only a single method for gas removal—the diffusion mechanism. In order to carry this out, the coal, upon relieving the load must be subjected to dispersion with formation of particles approximately 10' cm in size. The methane concentration in the coal will typically decrease several-fold, and it will pass into the free state.

The only mechanism capable of bringing about a dispersion of the coal and the development of an anomalous network of microfracturing is the bursting of gas bubbles interspersed in the structure of the coal bed, which begin to be actively released under periodic directional broadband pulsed plasma action having direct access to the coal bed through a slit perforation, creating acoustic and hydrodynamic cavitation.

The water penetrating into the coal bed with dissolved gas has low strength, due to the presence in it of cavitation nuclei: poorly wettable coal surfaces, coal particles with cracks and microcracks, which are filled with gas.

Upon formation of a plasma in the region of the working slit interval, sound is emitted into the liquid with sonic pressure of more than 100 db, which results in the formation of cavitation bubbles during the half-periods of rarefaction on the cavitation nuclei of the gas inclusions contained in the liquid and on the oscillating surfaces of the acoustic emitter. The bubbles collapse during the half-periods of compression, creating briefly for the time of one microsecond a pressure of as much as 10,000 kg/cm$^2$, which is able to break up stronger materials than coal.

Figure 2:
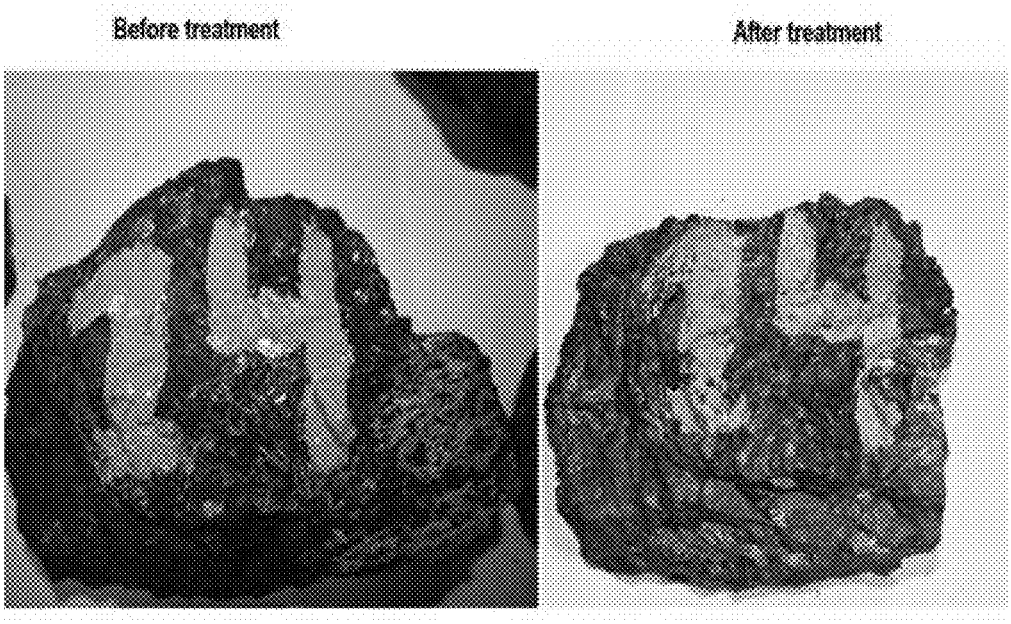
FIG. 2 shows before and after photographs of coal specimens subjected to testbed-based testing of a broadband pulsed plasma direct periodic action on said specimens placed in the zone of the shock wave produced by methods according to aspects of the present invention. These photos illustrate destratification of the coal into wafer-like sheets following application of the broadband pulsed plasma direct periodic action.

During testbed-based testing of a broadband pulsed plasma direct periodic action on coal specimens placed in the zone of the shock wave, the dispersing effect as well as the destratification of the coal into wafer-like sheets was confirmed (FIG. 2).

Figure 3:
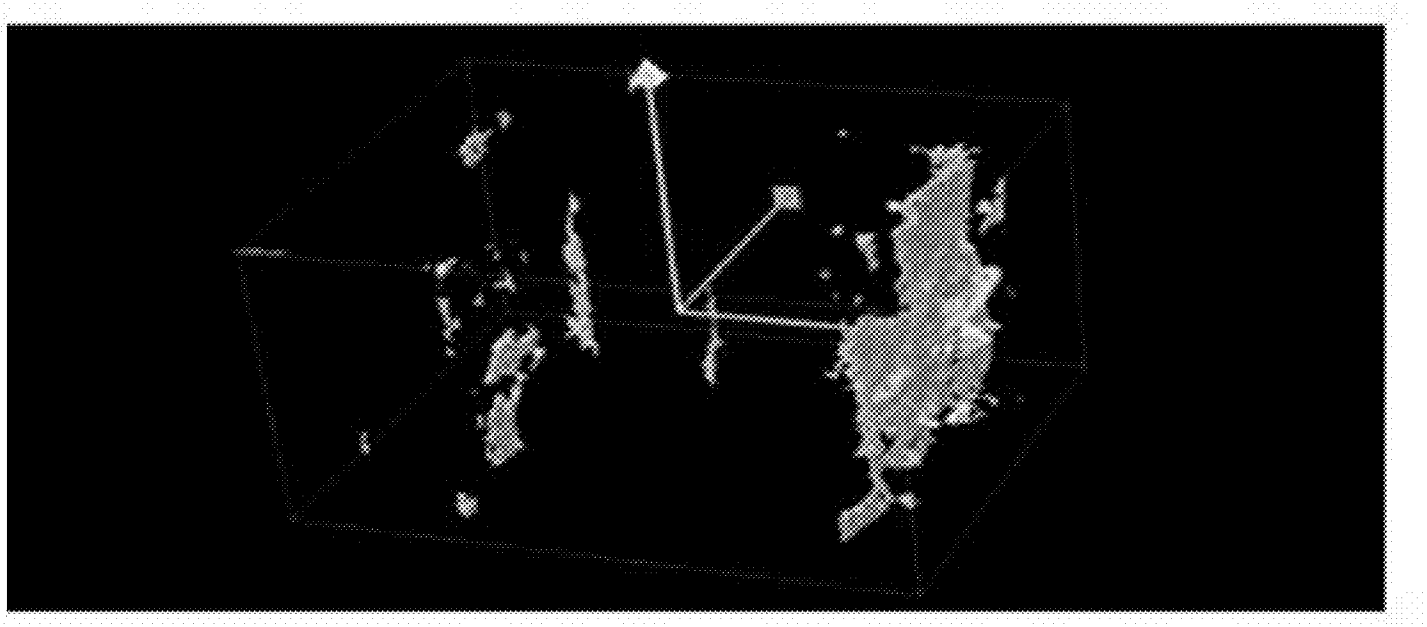
FIG. 3 shows a tomographic X-ray of specimens undergoing the pulsed plasma periodic broadband action through a slit perforation according to aspects of the present invention. X-ray tomography reveals the development of microfracturing in the specimen following application of the broadband pulsed plasma direct periodic action. The majority of the microcracks are shown to be situated orthogonally to the direction of stratification.

Tomographic X-raying of specimens undergoing the pulsed plasma periodic broadband action through a slit perforation revealed the development of microfracturing in the specimen, the majority of the microcracks being situated orthogonally to the direction of stratification (FIG. 3).

Figure 4:
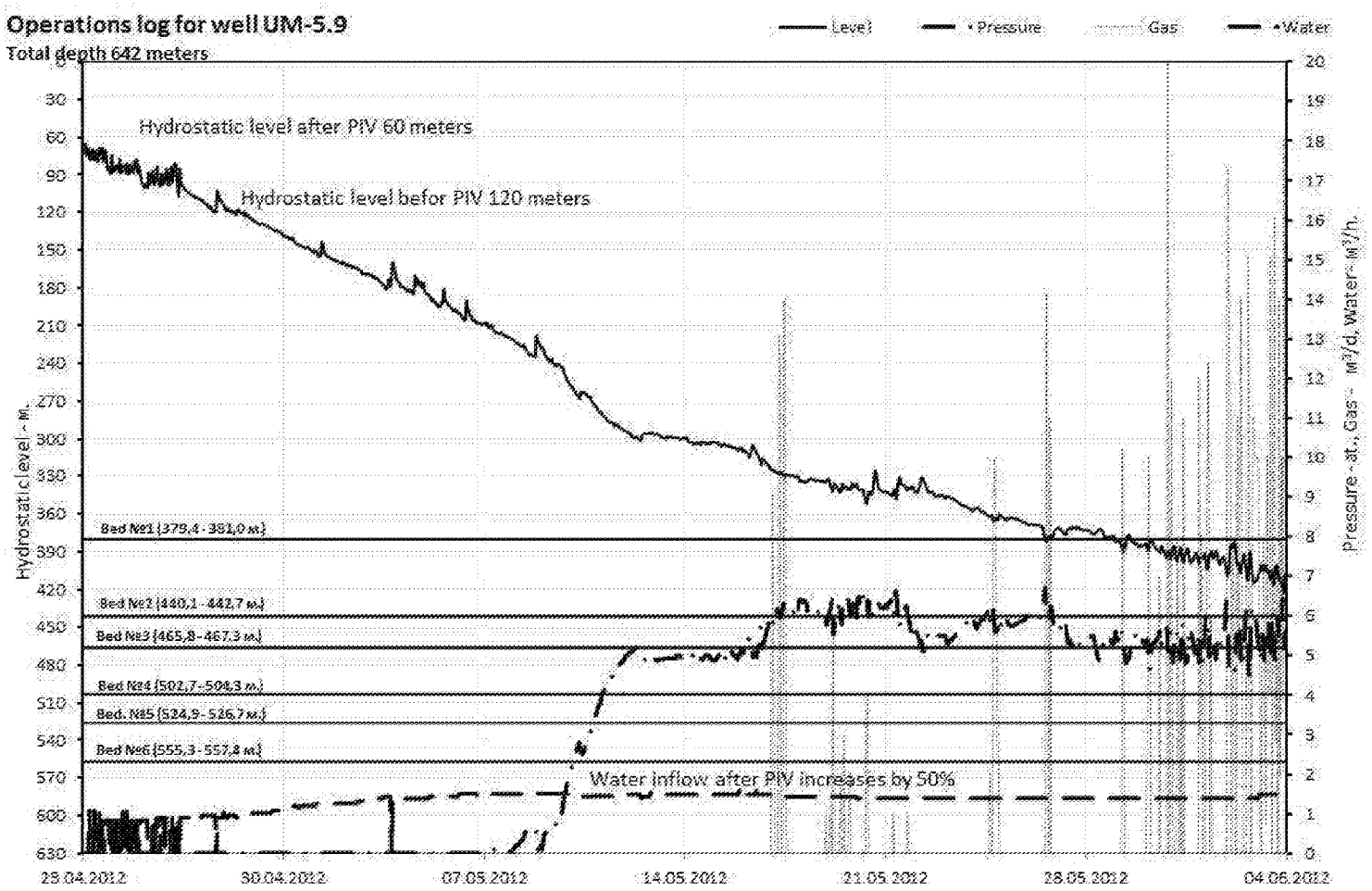
FIG. 4 is a graph showing operations for well UM-5.9 in at the Tallinn field in the Kuzbas. Increased permeability is observed after application of the broadband pulsed plasma direct periodic action on 6 methane coal beds.

The use of the pulsed plasma technology at well UM-5.9, having a slit perforation, at the Tallinn field in the Kuzbas has confirmed the increased permeability after action on 6 methane coal beds (FIG. 4).

Figure 5:
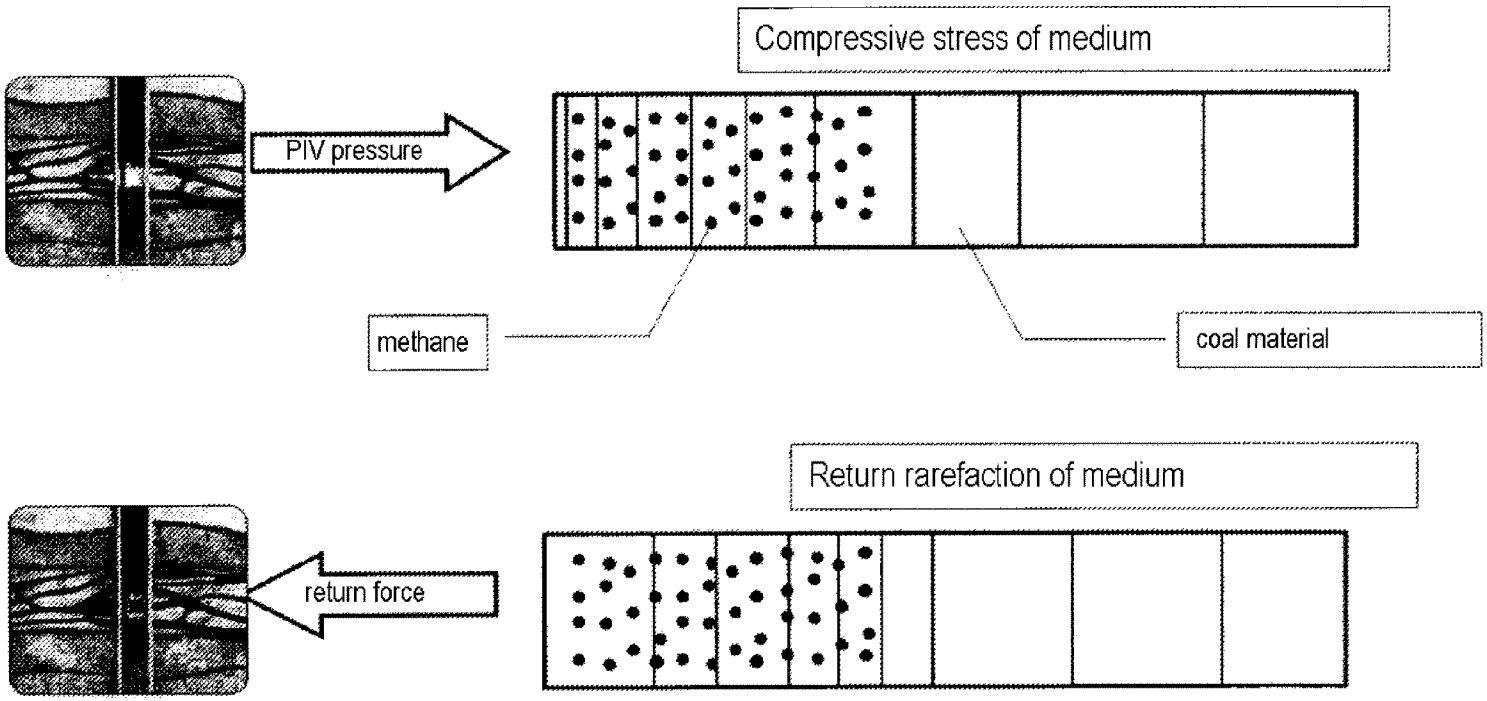
FIG. 5 is a diagram showing passage of methane into the well and by the propagation of the compressive and rarefactive stresses.

The use of the pulsed plasma technology in China, in the Pin Din Shan district in beds having a permeability of 0.014 mJ has confirmed the increased permeability of the bed by the passage of methane into the well and by the propagation of the compressive and rarefactive stresses to a distance of more than 200 meters, accompanied by active excretion of methane (FIG. 5).

Methods of extraction according to various embodiments of the provide multiple benefits and compared to methods previously known in the art. In particular, various embodiments of the invention allow one to maximize the volume of extracted gas, both from coal beds and from more permeable enclosing rocks, while incurring minimum energy expenses. Furthermore, methods according to the present invention are comparably safer and more environmentally responsible than methods known in the art. In particular, the present invention is free of harmful chemicals and is an ecologically safe approach to methane extraction, which sets it apart from conventional fracturing methods. However, methods of the present invention may also be used in combination with existing methods and new methods or a combination thereof, including agent-assisted fracturing methods, hydro-slotted perforation (slit-cutting) or heating the well bore area using chemical or biological agents.

Methods of extraction according to one preferred aspect of the invention include the following steps:

drilling a vertical well at a previously inspected methane coal bed (or using an old developed or undeveloped well), determining the thickness of the bed in the well profile, determining one or more parameters of the coal bed, e.g., the grade composition of the coal, the stratal pressure, the temperature, the hydrology, the porosity and permeability of the coal beds and enclosing rocks;

determining the gas saturation of the coal beds, applying a source of periodic directional broadband short pulses of high pressure to the methane coal deposit, including the coal bed and permeable enclosing rocks, through a slit perforation of the working interval of the vertical well, acting on the bed and the permeable enclosing rocks with the energy of a plasma formed by the explosion of a calibrated metallic conductor, in the form of periodic directional compressive and rarefactive short pulses of high pressure, the number of the high pressure pulses and the length of action in each interval of the methane coal deposit being determined by the thickness of the bed in the well profile, the petrophysical and grade composition of the coals, and also by the geological technical characterization of the enclosing permeable rocks.

The extraction of coalbed methane by the disclosed methods is performed on a methane coal deposit not relieved of the load of the rock pressure by means of vertical wells drilled from the top surface, encased with production casings of different diameter and having a slit perforation in the region of the working interval, relieving the load on both the coal bed and the permeable encasing rocks.

FIG. 1 shows a diagram of the result of the periodic action of plasma energy on the coal deposit according to one aspect of the invention. In this exemplary aspect, a ready-made well is used (previously drilled), the thickness of the stratum is determined in the well profile, the grade composition of the coal is determined and the permeable enclosing rocks are characterized, after which there is brought up to the methane coal deposit through a slit perforation of the working interval of the vertical well a source of periodic directional short broadband pulses of high pressure and the action on the bed commences in the form of periodic directional short pulses of high pressure, the number of high pressure pulses and the length of action in each interval of the methane coal deposit being determined by the thickness of the bed in the well profile, the grade composition of the coals and the characterization of the enclosing rocks. The source of periodic directional broadband short pulses of high pressure acts by the energy of the plasma formed by the explosion of a calibrated metallic conductor. By its nature, the source of the periodic directional short pulses of high pressure represents a generator of pulsed plasma action.

In selected aspects, a plasma energy source compatible with disclosed methods works as follows. High-voltage current (3000-5000 V) from a bank of storage capacitors is applied to electrodes, which make a circuit via the calibrated conductor, resulting in its explosion and the formation of a plasma in the enclosed space. During the explosion, energy is released, passing into the state of a highly heated gas with very high pressure, which in turn forms a shock wave, acting with great force on the surroundings, causing them to be compressed, which continues until the pressure in the shock wave is equalized with the stratal pressure, after which the process of rarefaction of the stratum occurs in the direction of the well with the source of excitation. The multiple repeating of the periodic broadband short pulses in a medium having good electrical conductance and sound conductance, bringing about compressive and rarefactive stresses, results in the development of a network of anomalous microfracturing in the bed, cavitation, exchange of heat and mass, and self-modulation of the bed, which promotes maximum desorption of the methane.

In the event that more permeable enclosing rocks are present, the pulsed plasma action is propagated into these rocks, since the methane diffuses into the more permeable rocks and its volume may exceed the volume of methane in the coal bed. The permeable enclosing rocks behave like an oil and gas producing collector, not having any coal dust, and therefore the gas output will be maximized.

In the interest of clarity, not all of the routine features of the aspects are disclosed herein. It would be appreciated that in the development of any actual implementation of the present disclosure, numerous implementation-specific decisions must be made in order to achieve the developer's specific goals, and these specific goals will vary for different implementations and different developers. It is understood that such a development effort might be complex and time-consuming, but would nevertheless be a routine undertaking of engineering for those of ordinary skill in the art, having the benefit of this disclosure.

Furthermore, it is to be understood that the phraseology or terminology used herein is for the purpose of description and not of restriction, such that the terminology or phraseology of the present specification is to be interpreted by the skilled in the art in light of the teachings and guidance presented herein, in combination with the knowledge of the skilled in the relevant art(s). Moreover, it is not intended for any term in the specification or claims to be ascribed an uncommon or special meaning unless explicitly set forth as such.

The various aspects disclosed herein encompass present and future known equivalents to the known modules referred to herein by way of illustration. Moreover, while aspects and applications have been shown and described, it would be apparent to those skilled in the art having the benefit of this disclosure that many more modifications than mentioned above are possible without departing from the concepts disclosed herein.

The invention claimed is:

1. A method of extracting methane from a coal deposit, comprising the steps of:

drilling a vertical well at the site of a coal bed;

determining the thickness of the coal bed;

determining one or more parameters of the coal bed, comprising at least one of the coal grade or composition, stratal pressure, temperature, hydrology, porosity, or permeability of either the coal bed or rock enclosing the coal bed;

determining a methane gas saturation of the coal bed;

placing a plasma energy source in contact with the coal deposit through a slit perforation of the working interval of the vertical well; and activating the plasma energy source;

wherein the plasma energy source comprises a metallic conductor and is configured to emit periodic directional short pulses of high pressure upon activation by exploding the metallic conductor wherein the plasma energy source is configured to generate acoustic and hydrodynamic cavitation in the coal bed and release methane gas bubbles from the coal bed.

2. The method of claim 1, wherein a second slit perforation is created in permeable rock enclosing the coal bed, such that the direction of the second slit perforation is oriented along the directions of the principal stresses of the rock.

3. The method of claim 1, wherein the plasma energy source is configured to create a common network of anomalous microfracturing in the coal bed and cracks and microcracks in permeable rock enclosing the coal bed.

4. The method of claim 1, wherein the plasma energy source is configured to create a common network of microcracks in the coal bed and in at least one secondary coal bed located above or below the coal bed.

5. The method of claim 1, wherein the coal bed is at the site of a previously developed or underdeveloped well.

6. The method of claim 1, wherein the coal bed is a previously inspected methane coal bed.

7. The method of claim 1, wherein the plasma energy source is configured to generate acoustic, electrical, mechanical and hydrodynamic compressive and rarefactive stresses in the coal bed.

8. The method of claim 1, wherein the number of the periodic directional short pulses of high pressure and the duration of activation are determined based upon the thickness of the coal bed, the coal grade or composition, and the permeability of the coal bed or rock enclosing the coal bed.

9. A method of extracting methane from a coal deposit, comprising the steps of:

drilling a vertical well at the site of a coal bed;

determining the thickness of the coal bed;

determining one or more parameters of the coal bed, comprising at least one of the coal grade or composition, stratal pressure, temperature, hydrology, porosity, or permeability of either the coal bed or rock enclosing the coal bed;

determining a methane gas saturation of the coal bed;

placing a plasma energy source in contact with the coal deposit through a slit perforation of the working interval of the vertical well; and activating the plasma energy source;

wherein the plasma energy source comprises a metallic conductor and is configured to emit periodic directional short pulses of high pressure upon activation by exploding the metallic conductor;

wherein the plasma energy source is configured to create a common network of anomalous microfracturing in the coal bed and cracks and microcracks in permeable rock enclosing the coal bed.

10. The method of claim 9, wherein a second slit perforation is created in permeable rock enclosing the coal bed, such that the direction of the second slit perforation is oriented along the directions of the principal stresses of the rock.

11. The method of claim 9, wherein the coal bed is at the site of a previously developed or underdeveloped well.

12. The method of claim 9, wherein the plasma energy source is configured to create a common network of microcracks in the coal bed and in at least one secondary coal bed located above or below the coal bed.

13. The method of claim 9, wherein the plasma energy source is configured to generate acoustic, electrical, mechanical and hydrodynamic compressive and rarefactive stresses in the coal bed.

14. A method of extracting methane from a coal deposit, comprising the steps of:

drilling a vertical well at the site of a coal bed;

determining the thickness of the coal bed;

determining one or more parameters of the coal bed, comprising at least one of the coal grade or composition, stratal pressure, temperature, hydrology, porosity, or permeability of either the coal bed or rock enclosing the coal bed;

determining a methane gas saturation of the coal bed;

placing a plasma energy source in contact with the coal deposit through a slit perforation of the working interval of the vertical well; and activating the plasma energy source;

wherein the plasma energy source comprises a metallic conductor and is configured to emit periodic directional short pulses of high pressure upon activation by exploding the metallic conductor;

wherein the number of the periodic directional short pulses of high pressure and the duration of activation are determined based upon the thickness of the coal bed, the coal grade or composition, and the permeability of the coal bed or rock enclosing the coal bed.

15. The method of claim 14, wherein a second slit perforation is created in permeable rock enclosing the coal bed, such that the direction of the second slit perforation is oriented along the directions of the principal stresses of the rock.

16. The method of claim 14, wherein the coal bed is at the site of a previously developed or underdeveloped well.

17. The method of claim 14, wherein the plasma energy source is configured to create a common network of microcracks in the coal bed and in at least one secondary coal bed located above or below the coal bed.

18. The method of claim 14, wherein the plasma energy source is configured to generate acoustic, electrical, mechanical and hydrodynamic compressive and rarefactive stresses in the coal bed.

* * * * *